US005464032A

United States Patent [19]

Litterst

[11] Patent Number: 5,464,032

[45] Date of Patent: Nov. 7, 1995

[54] DISH WASHING UNIT FOR TRAYS LOADED WITH DISHES

[75] Inventor: Jürgen Litterst, Offenburg, Germany

[73] Assignee: Premark FEG Corporation, Wilmington, Del.

[21] Appl. No.: 172,149

[22] Filed: Dec. 23, 1993

[30] Foreign Application Priority Data

Dec. 23, 1992 [DE] Germany ..... 42 43 892.6

[51] Int. Cl.[6] ..... B08B 3/02

[52] U.S. Cl. ..... 134/72; 134/78; 134/131

[58] Field of Search ..... 134/62, 68, 72, 134/78, 82, 131; 198/416, 469.1, 482.1; 414/222, 223

[56] References Cited

U.S. PATENT DOCUMENTS

| | | | |
|---|---|---|---|
| 3,486,939 | 12/1969 | Pinckard | 134/62 |
| 3,627,106 | 12/1971 | Winfield | 198/469.1 |
| 3,768,493 | 10/1973 | Kraeft | 134/62 |
| 3,798,065 | 3/1974 | Kittermann | 134/72 |
| 3,938,533 | 2/1976 | Richard | 134/62 |

FOREIGN PATENT DOCUMENTS

| | | | |
|---|---|---|---|
| 0292773 | 11/1988 | European Pat. Off. . | |
| 0512279 | 11/1992 | European Pat. Off. . | |
| 0603885 | 12/1993 | European Pat. Off. . | |
| 1432310 | 3/1969 | Germany | 134/62 |
| 1956049 | 5/1971 | Germany . | |
| 2156543 | 6/1973 | Germany | 134/62 |
| 7404506 | 2/1974 | Germany . | |
| 2424289 | 11/1975 | Germany . | |
| 2430055 | 1/1976 | Germany . | |
| 2443651 | 4/1976 | Germany . | |
| 2733536 | 12/1978 | Germany | 134/62 |
| 3319832 | 12/1984 | Germany . | |
| 3413480 | 10/1985 | Germany . | |

*Primary Examiner*—Frankie L. Stinson
*Attorney, Agent, or Firm*—Thompson, Hine and Flory

[57] ABSTRACT

In a dish washing unit for trays loaded with dishes having a separating stage with a turning device, a delivery and removal stage and a washing stage, the supply conveyor is a transverse conveyor belt with a right-angle deflector. Additionally, the inner conveyor belt of the turning conveyor is a lattice belt which in the discharge direction has a substantially pear-shaped eccentric rotating path and is guided at its outer edge. The outer belt is a double-chain conveyor belt, the outer and inner strands of which are spaced and guided substantially parallel to one another and to the turning semicircle. Removing belts are present in the same number as the items to be washed of different dimensions. Finally, washing transport belts are provided in vertical superimposed parallel arrangement in the washing station such that they respectively cooperate with one of the removing belts and further convey the flatly lying items to be washed through the washing, rinsing and drying zones.

20 Claims, 2 Drawing Sheets

DISH WASHING UNIT FOR TRAYS LOADED WITH DISHES

Figure 1:
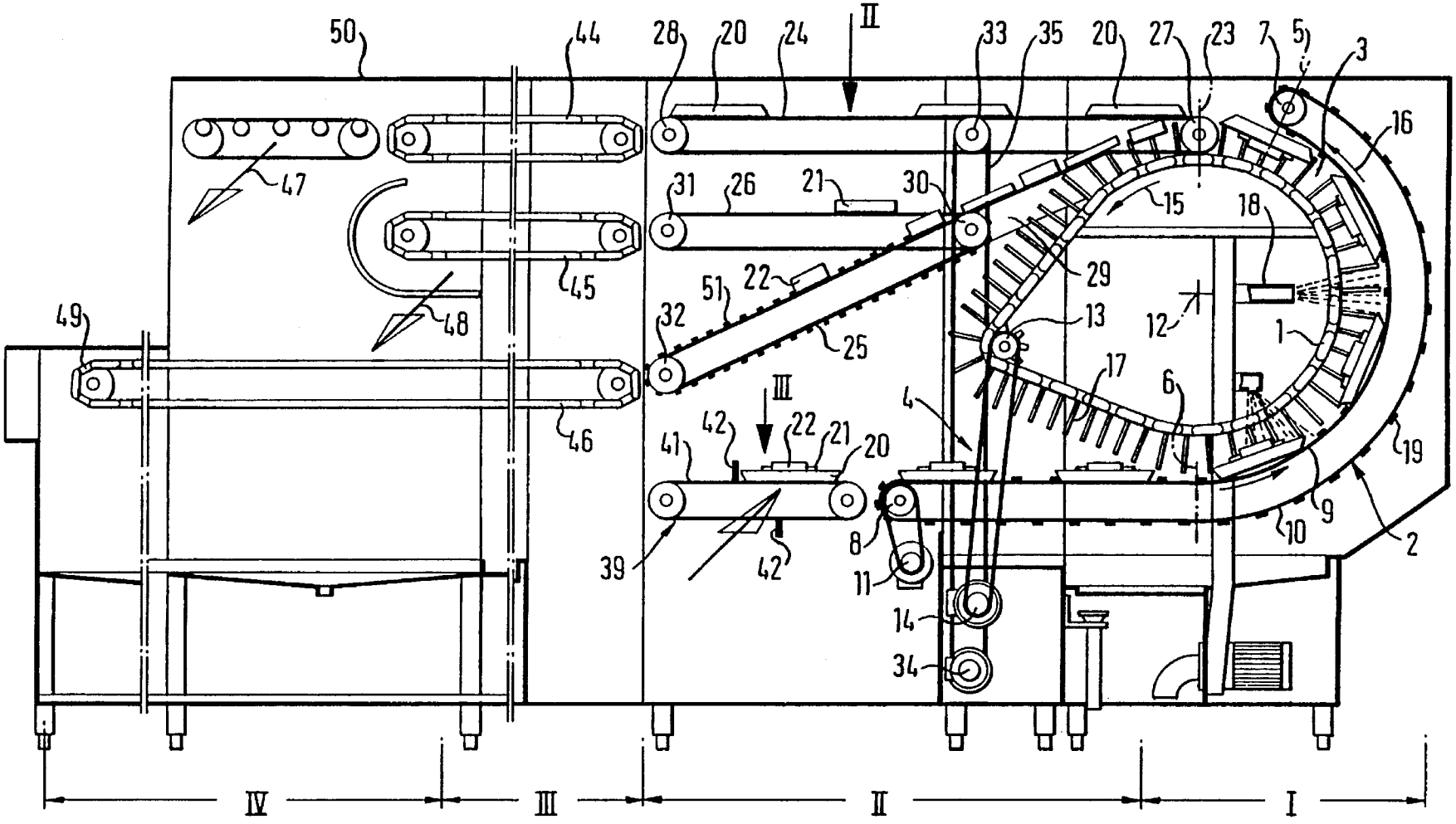

The invention relates to a dish washing unit for trays loaded with dishes according to the preamble of claim 1, as used, for example, in self-service restaurants, company canteens and other large canteens or restaurants.

Such a unit is known from DE-B-34 13 480 in which a dish washing unit with a feeding, turning, sorting and clearing device and the feedthrough of the items to be washed on conveyor belts through the dish washing part of the unit is described. The trays with the dishes thereon are supplied to the turning device with their short side perpendicular to the axis of the device (transverse arrangement). This turning and sorting device consists of a turning drum led over a conveyor belt having finger members pointing outwardly which engage with the supplied dishes while conveying these. The turning semicircle of the inner conveyor belt is surrounded by a strand of an opposing conveyor belt in such a manner that this maintains the loaded trays supplied between both belts against the finger members of the inner conveyor belt. A tray conveyor somewhat displaced from the upper summit of the turning semicircle or the turning drum and somewhat rearwardly in the direction of the washing machine part is arranged in such a manner that it lifts the trays with the conveyor belt, upon which the items to be washed turned by 180° lie on the finger members, lifts the trays and guides these substantially horizontally through the washing machine part. The inner conveyor belt in the turning device extends at its opposite end so far in the discharge transporting direction that the dishes lying flat on the finger members of its upper strand are conveyed through at a slightly descending angle through the entire dish washing part.

On account of the supply of the loaded trays by the supply conveyor very closely beneath the turning drum out of a region in which the outer opposing belt and the inner conveyor belt lie upon one another without a fixed spacing, a clogging of and also damage of the trays and the dish parts on account of the driving force of both conveyors can occur. Furthermore, it is more disadvantageous that, on the one hand, the relatively long conveyor belt having the finger members, and, on the other hand, the tray conveyor continuously runs through the washing machine part, where they are exposed to high heating effects and the effect of very aggressive detergent. On account of this, in particular the finger members of the inner turning and dish conveying belt suffer to a large extent so that the life thereof is very short. Additionally, by guiding through all dishes by means of the conveyor equipped with the finger members, operation only takes place with relatively low feed rates unless the washing machine part has a relatively large length, which on the other hand has a negative effect on account of high large requirements.

A clearing device for used food dishes is known from DE-B24 43 651 and has an apparatus section for feeding, turning and sorting the items to be washed. A clearing drum extending about a horizontal axis is provided with radially aligned elastic feed fingers mounted to the drum which are opposed by a plurality of fixed bent rails that form a turning channel with the drum surface. As seen in the feed direction of the clearing drum, discharge conveying devices in the form of slides, belts or the like are provided behind the upper end of the turning channel in order to discharge trays arriving in the turned position, advantageous in terms of washing separately from the dishes perpendicularly to the feed direction into the non-described washing device. A complete unit which possibly has a space-saving arrangement as well as a possible pre-washing step is not described.

A clearing device for used food trays is also known from EP O 292 773 A2 (88 107 486.8) in which a turning drum with radial conveying fingers together with fixed bent rails also form a turning channel for the items to be washed, axial spray nozzles being provided in the turning channel for pre-washing. The discharge of the trays ensues by means of a tray conveyor which in the initial section leads the trays at an angle upwardly and then horizontally into and through a washing machine. The dishes are placed by a slide lying therebeneath, upon which further pre-washing nozzles act, at an angle downwardly onto a washing machine conveyor belt which feeds the flat lying dishes to the washing machine; the lower feeding slide is associated with an itemizing transport device which sequentially feeds the dishes onto the washing machine conveyor. In which form the further conveyance takes place in the washing machine is not described. The itemizing transport device of this known apparatus is structured in a relatively complicated manner and requires a relatively large amount of space in the longitudinal direction of the apparatus.

Furthermore, the trays initially fed away at an angle upwards require a large structural height. A fully automatic washing device for dish trays is also known in which the loaded trays are delivered by a roller feed conveyor into a turning apparatus and in the turning channel of which they are conveyed between an inner and an outer conveyor belt. The outer conveyor belt driven with both strands parallel to one another and is also parallel to the inner belt at the level of the turning semicircle is substantially extended with its one end up to the summit of the turning semicircle while the other end passes into a horizontal supply section. The inner belt path is slightly pear-shaped and has outwardly projecting holding/conveying rods. The inner belt is formed as a lattice belt so that the washing items can already be pre-washed from the inside during turning. The trays and dishes are taken from the turning device by removing and sorting belts and supplied to three further conveyors running transversly to the feeding, turning and removal direction. Trays and plates are then transported in vertical arrangement through a washing machine while the dishes run through a further parallel washing machine. It is clear that a very complex unit requiring a lot of space is used here which cannot be operated in large kitchens with little available space.

It is therefore the object of the invention to improve the apparatus initially described such that a compact robust unit is provided with a large efficiency, long life and low space requirement. This object is solved in accordance with the invention by a dish washing unit having the characterizing features of claim 1. Advantageous embodiments of the inventive subject matter are described in the dependent claims.

Accordingly, the inventive dish washing unit, which substantially consists of a separating stage, a supply and removal stage, a washing, rinsing and drying stage and a discharge stage, is equipped with a supply conveyor which is a transverse conveyor belt with a right-angle deflector. On account of this, the advantage is achieved that the dish trays can be fed perpendicularly into the unit so that in the actual washing, rinsing and drying stage, a substantially active washing height can be obtained.

It is also important for the invention that as many removing conveyors are arranged vertically above one another as there are washing items (e.g. trays, plates, dishes) of different outer transverse dimensions which must be transported. Additionally, in the washing, rinsing and drying stage, respective washing transport conveyors for cooperating with one of the removal sorting conveyors and further conveying the respective items to be washed lying flat to the separate final item discharge are provided in superimposed parallel arrangement. On account of this, the considerable advantage is obtained that for all items to be washed such as trays, plates and bowls, only a single washing, rinsing and drying tunnel is required in which the sorted trays and dishes are conveyed in vertically superimposed and simultaneously parallel belts through the washing, rinsing and drying stage. On account of this, a lot of space is saved in the transverse direction of the unit as only one and not two or more adjacent washing tunnels or washing machines are used. On account of the flat conveyance of the items to be washed on the vertically superimposed and respectively parallel washing belts, the possibility often exists to arrange these belts in space-saving arrangement above one another in such a manner that relatively low structural heights are required and a very good washing, rinsing and drying treatment is still possible.

It is advantageous if the inner turning belt is formed as a lattice belt which has a substantially pear-shaped eccentric transport path in the discharge transport direction. The lattice belt is guided continuously along its outer edge, wherein radial nozzles for the pre-washing of the items to be washed are provided which operate through this along the turning semicircle. On account of this measure, the considerable advantage is provided that the inner turning belt is relatively short and saves space. On account of the length of the inner belt being reduced to a minimum, and in particular on account of the fact that the inner belt is not conveyed through the washing, rinsing and drying unit with the high temperatures and aggressive agents, a long lifetime of the belt, not a cheap part in terms of its cost of procurement, is obtained. By forming the inner belt as a lattice belt, the possibility is also given of prewashing the conveyed items to be washed in particular by means of radial nozzles. The items to be washed conveyed into the actual washing machine are thus already freed of the coarser dirty matter on account of which the washing stage can be designed to be more simple and shorter. The outer turning belt is in this case formed as a chain conveyor belt in which the inner and outer strands are guided spaced from and substantially parallel to one another and also simultaneously parallel to and at a distance to the inner belt to form a turning channel with this. As the inner and outer belts run synchronously and at an exact spacing along the turning semicircle, optimal supply and turning properties are ensured. In this case, it is advantageous if the outer belt is provided with tray conveyors arranged on the belt side so that the conveying of trays not only takes place by means of the force of the fingers of the inner belt engaging in the dishes, but that a pushing or supporting of the transported trays also simultaneously takes place. In this case, it can be of considerable advantage if the tray is placed by the right-angle deflector onto the horizontal receiving section of the supply region of the outer belt in such a manner that the tray is first removed by a receiver of the belt from, for example, lateral support rails and delivered into the turning semicircle.

In order to save more space and simultaneously achieve a secure removal of the trays and dishes from the inner belt, the outer belt or its upper deflection roller is rearwardly displaced by up to 30° with respect to the upper summit of the turning semicircle. In this manner, the upper tray removing belt can extend to the summit of the turning semicircle, on account of which a tangential removal of the trays from the summit of the semicircle takes place so that more space remains for the arrangement of further removing belts beneath the upper tray removing belt.

According to a further embodiment, as already briefly revealed, the first removing belt is the tray removing belt which is tangentially led away horizontally from the upper summit of the turning semicircle. A downwardly inclined belt, the inclined belt, is provided as a second belt in such a manner that it initially receives all the dishes of the items to be washed with its one end and cooperates at its lower end with the lowermost washing belt. Depending on the further number of items to be washed of different dimensions, a corresponding number of intermediate removing belts are provided which extend substantially horizontally and coact respectively with one of the intermediate washing belts. Thus, for example, for three items to be washed, such as a tray, a plate and a salad bowl, an upper horizontal tray belt, an inclined belt which delivers the salad bowl to the lower washing belt and a horizontal intermediate or middle belt which removes the plate from the inclined belt and delivers this to the intermediate washing belt are provided. Consequently, the same number of removing belts and washing belts as the number of items to be washed are provided.

In a further embodiment of the invention, after the removal of the trays by the upper horizontal removing belt, lead-in angles leading to the inclined belt from the upward summit of the turning semicircle can be provided on both sides of the belt which place the dish parts in such a manner onto the downwardly leading inclined belt that at least the larger plates are relatively central and the bowls or small parts lie securely on the narrower inclined belt. In this case, it is very advantageous if the inclined removing belt has an anti-slip arrangement on its outer belt side carrying the dishes. This can consist of differently shaped profiles or projections such as transverse beads, burls or the like. In order to prevent sliding both in the downward transport direction as well as to the sides of the belt, it is further advantageous if, in the case of grooves or beads, these have a V-shape in such a manner that the V points with its tip in the downward transport direction.

However, there is also the possibility of forming the inclined removing belt in its first part, namely up to the beginning of one of the subsequent intermediate removing belts, as a removing slide which has lateral guide walls formed as inwardly directed lead-in angles in the transition part to the inclined belt. It can be recognized that it is only sensible to lead the removing slide up to a first intermediate belt, as too long an acceleration path would otherwise be provided for the dishes.

It is also particularly advantageous if the horizontal removing belts are all formed as chain conveyor belts. On account of this, a light open structure is achieved which is favourable for the transport of pre-washed dripping items to be washed and additionally have a long life and low susceptance to failure. Furthermore, a total cleaning of the unit is also simplified through this embodiment.

It is also effective if the supply belt is a driven roller belt which supplies the trays in the transverse direction of the unit, i.e. in the axial direction of the turning device, and if a tray supply belt arranged between the last rollers of the supply belt effective in the same direction as the outer band is provided as a right-angle deflector. In this case, it is advantageous if the supply roller belt has an end stop on the longitudinal side at its transport end, namely for the trays arriving with their narrow side in front. This end stop is arranged in correspondence with the arrangement of the rearward side guide of the outer belt as seen in the supply transport direction so that an exact delivery of the tray onto the chain conveyor is achieved. The tray supply belt is in this case arranged relative to the end stop in such a manner that it engages substantially centrally with the long side of the tray and pushes this. On account of this measure, a safe parallel pushing of the loaded trays is achieved when either the supply belt itself or the pusher are somewhat wider or these have at least a wider pusher in order to also safely deliver the tray. However, for this purpose, instead of a central belt, two belts can be provided which run synchronously with respect to one another and the pushers of which practically simultaneously engage the longitudinal side of a respective tray and push this safely and transversly to the supply direction.

The tray supply belt or supply belts can be respectively equipped with one or more pushers. This is naturally dependent on the belt length, the tray supply speed and the spacings in which the trays are delivered from the roller belt into the unit.

Naturally, it is particularly advantageous if the various conveyor belts, in particular the transverse conveyor belt of the supply conveyor and the supply belt, are matched to one another in respect of the supply frequency with the conveyor speed of the turning device up to the washing belts.

Figure 2:
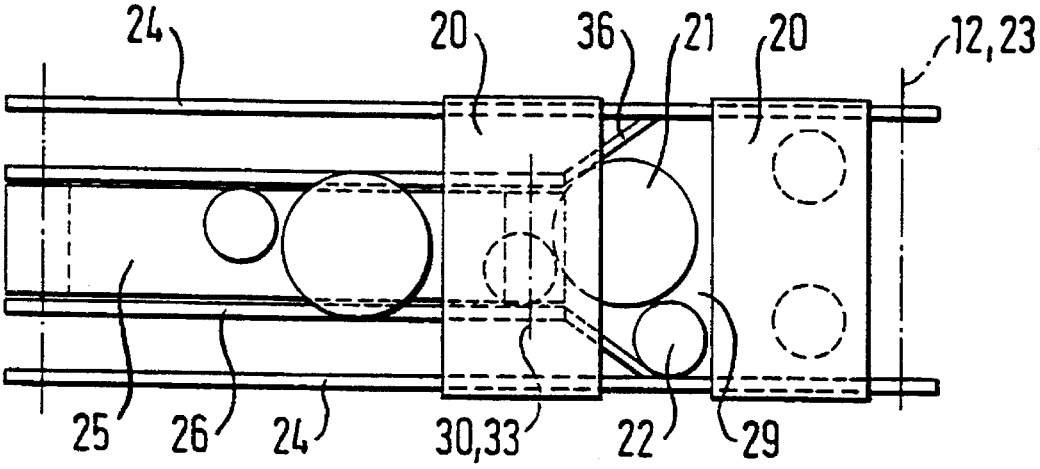
Figure 3:
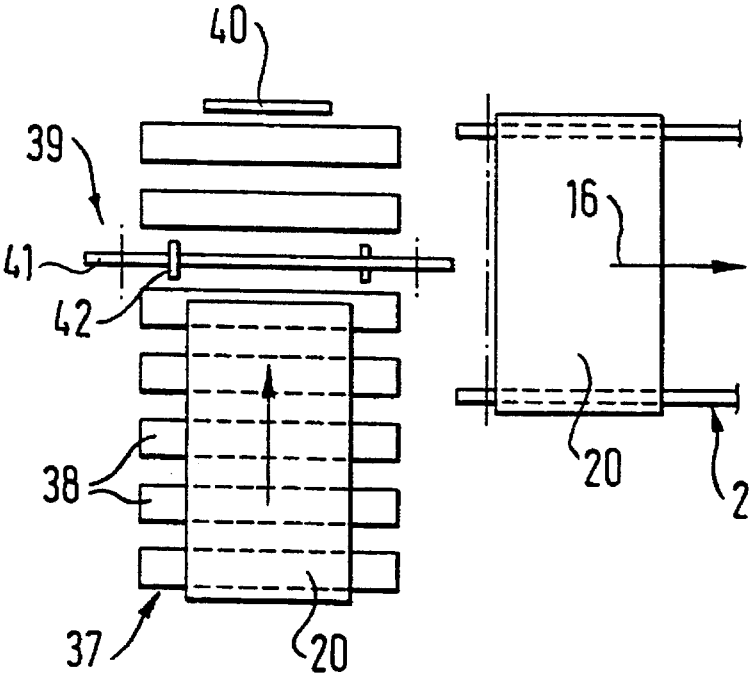

In the following, the invention is described in more detail on the basis of an exemplified embodiment with reference to the drawings in which:

FIG. 1 shows an open cross-sectional view with a partial longitudinal section through an inventive dish washing unit, FIG. 2 shows a vertical plan view according to arrow II in FIG. 1 displaying the arrangement of the removing belts, and FIG. 3 shows a vertical section according to arrow III in FIG. 1 on the supply belt with the right-angle deflector.

It can be seen in FIG. 1 that the inventive dish washing unit consists of several stages arranged sequentially behind one another in the washing and, simultaneously, the longitudinal direction. Thus, a separating and pre-washing stage I, a delivery and removal stage II, a washing, rinsing and drying stage III and a discharge stage IV are provided. In the drawing, FIG. 1, the washing, rinsing and drying stage III in particular is shown in a substantially shortened form so that the individual sub-stages, for example, the arrangement of two washing stages, followed by a rinsing stage and a drying stage, cannot be recognized.

The separating and pre-washing stage I consists substantially of a pear-shaped continuous inner belt 1 which on its circular periphery is partially surrounded by an outer belt 2 such that a turning channel is formed between the inner and outer belt with a constant cross section. The outer belt 2 is basically formed as a chain conveyor belt which has two parallel and synchronously running chains. The conveyor chains are guided so that a constant spacing also to the inner belt is ensured.

The outer belt 2 extends horizontally into a first supply area 4 and passes over at the lower end 6 of the turning channel 3 into a semicircular region as seen from the side. This ends at the upper discharge end 5 of the turning channel 3 and extends over an upper deflection roller 7 as an outer strand 10, substantially parallel to the inner strand 9, and back to the lower or driving roller 8. The driving roller 8 is connected to a drive 11.

The inner belt 1 consists of an endless inner lattice belt which is guided on a pear-shaped path while including the central point of curvature 12 of the turning semicircle. A pair of toothed wheels 13 rotatably driven by a drive 14 is arranged on the side facing away from the turning channel 3, each wheel engaging with its teeth into the inner lattice belt to drive the same. The direction of rotation of the inner belt 1 is shown by means of an arrow 15 and extends in the counter-clockwise direction about the central point of curvature 12 synchronously to the inner strand 9 of the outer chain conveyor belt of the outer belt 2 arranged behind the turning channel 3, the running direction of the outer belt being shown by a curved arrow 16. The lattice belt of the inner belt 1 is equipped with equidistantly spaced outwardly projecting conveying rods 17 which engage ill the dishes 20, 21, 22 transported into the turning channel 3 to support and convey these. These conveying rods 17 can have a substantially perpendicular alignment with respect to the belt plane or a radial alignment in the turning semicircle zone. However, they can also have an inclination of 10°–20° in the forward transport direction. The inclined embodiment has the advantage that a greater holding elasticity is also simultaneously provided. Inside the turning device, and with effect in the turning semicircle, there are arranged pre-washing nozzles 18 effective through the lattice belt of the inner belt 1 which pre-wash the items to be washed consisting of trays 20 loaded with plates 21 and bowls 22 passed through the turning channel 3, such that these are freed of coarser dirt.

It can be recognized that the upper end 5, i.e. the deflection roller 7 of the outer belt 2, is set back from the summit 23 of the turning device at the periphery. This rearward displacement can be approximately 30° and has the advantage that, on the one hand, structural height is reduced and, on the other hand, no structural measures are provided at the summit 23 which would hinder the mounting of further parts such as removing conveyors. Additionally, the belt length and the length of the feed associated with this is thus shorted. In this case, no disadvantages in respect of the further transport of the turned items to be washed must be feared, as these are already securely positioned on the conveying rods 17 and transported away over the summit 23.

Removing conveyors 24, 25, 26 are provided in the delivery and removal stage II in the upper section via which the turned items to be washed are removed from the conveying rods 17 of the inner belt 1 and flatly conveyed further to the washing stage III.

The upper removing belt 24 is a horizontal tray belt 24 which is formed as a double-chain belt and guided over two deflecting rollers 27 and 28. The first deflecting roller 27 is arranged tangentially to the inner belt at the summit 23 in such a manner that it surrounds the inner belt so that the chains of the tray belt 24 lift the trays 20 off the conveying rods 17 and remove these horizontally.

Beneath the tray belt 24 and connected somewhat lower and displaced in the conveying direction of the inner belt 1 is a slide 29 arranged at an angle which also has the function of a removal device and passes over into an inclined belt 25 with the same inclination. However, it can be seen in FIG. 1 that the inclined belt 25 can also extend to engage directly between the conveying rods 17, on account of which a removing slide 29 is not necessary. The inclined belt cooperates at its lower end guided over the deflection rollers 32 with the lower washing belt.

The horizontal middle belt 26 arranged vertically beneath the tray belt 24 has substantially the same starting point as the inclined belt 25, i.e. they have at least the same driving axis 30 upon which the appropriate driving wheel pairs are provided respectively displaced in the transverse direction. The middle belt 26 extends at its opposite end about the deflection rollers 31 and is formed in the same manner as the tray belt 24 as a double-chain conveyor belt for the transport of the plates 21. It is to be noted that the deflection rollers 28, 31 and 32 are arranged vertically superimposed such that all three removing belts 24, 25 and 26 extend to the same vertical plane and are thus at an identical distance to the washing stage III. The inclined belt 25 can have a burled belt, i.e. it can be a normal transport belt with low-slip rubber or plastic coating, on the upper transport surface of which, for example, burls 51 or other projections are arranged as anti-slide means. The inclined belt 25 can, however, also be a lattice belt similar to the inner belt 1 but instead of the relatively long conveying rods 17, very short stopping burls or humps can be provided thereonto project in a stopper-like manner such that they secure the bowls 22 against sliding downwardly too quickly or away to the side.

It can also be recognized from FIG. 1 that drive rollers 33 for the tray belt 24 are arranged vertically above the drive axis 30 for the middle belt 26 and the inclined belt 25. Both the drive rollers 33 as well as the driving axis 30 are operatively connected by means of a driving chain or belt 35 with a drive 34. It can also be seen that the belt drives 11, 14, 34 are coupled together or can be connected such that the same belt speeds can be provided.

As can be seen in FIG. 2, tile removing slide 29 has leading angles 36 which extend into the width of the inclined belt 25 and practically centralise the plates 21 and bowls 22 moving downwardly on the slide 29 so that they are taken up by the following belts, i.e. the plates 21 by the middle belt 26 and the bowls 22 by the inclined belt 25, in a securely positioned manner.

As can be seen from FIG. 3 in connection with FIG. 1, a transverse conveyor 37 is arranged at the lower part of the delivery and removal stage II with its longitudinal extension adjacent to the forward driving end of the supply area of the outer belt. The transverse conveyor 37 consists of a driven roller belt 38 upon which the trays 20 with their narrow side in the forward direction, namely in longitudinal alignment, are supplied. It also has a right-angle deflector 39 by means of which the arriving trays are exactly positioned and pushed transversly from the roller belt and onto the conveyor chain of the outer belt 2.

The right-angle deflector 39 consists substantially of an end stop 40 which in terms of its stopping function is matched exactly with the rearward lateral guide of the outer belt 2. Additionally, the right-angle deflector 39 includes a tray supply belt 41 which is arranged between two adjacent rollers of the roller belt 38 in such a manner that it engages by means of at least one pusher 42, mounted on the upper side substantially centrally against the longitudinal side of a tray facing away from the outer belt and pushes this onto the outer belt 2. It can be seen that the tray supply belt 41 should have substantially the same transport speed as the outer belt 2 unless a kind of pushing runner or rails for more quickly displacing the trays is provided from which the trays can then be pushed onto the outer belt chains by means of the outer belt projections 19.

As can also be seen in FIG. 1, the shown supply belt 41 has two pushers 42 which are equally spaced on the belt outer side and have a height which somewhat projects beyond the tray edge so that a secure pushing via the upper tray edge can ensue.

As can be additionally seen in FIG. 1, all three removing belts, namely the tray belt 24, the middle belt 26 and the inclined belt 25, are respectively in front of a washing belt 44, 45, 46. The three washing belts 44, 45, 46 form part of the washing stage III and convey the horizontal flat lying items to be washed 20, 21, 22 through the appropriate washing, rinsing and drying sections to the discharge stage IV. The washing belts 44, 45, 46 are also chain belts or at least lattice belts which, on the one hand, are very easily penetrated by the sprayed washing and rinsing agents and the blown drying air and, on the other hand, are hardly prone to the very aggressive washing agents and large heating effects.

An upper lateral tray discharger 47, an intermediate lateral plate discharger 48 and a lower bowl discharger 49 are provided in the discharge stage IV such that these cooperate with the respective end of the washing belts 44, 45, 46. All four main stages I, II, III and IV are enclosed in a common housing 50 which, as can be recognized, can be designed with a minimal height and length and also with a relatively narrow transverse width only slightly greater than that of the trays.

I claim:

1. A dish washing unit for trays loaded with dishes, comprising:

a separating stage with a turning device consisting of an inner conveyor belt equipped at its outer side with substantially radially directed finger members/conveying rods and an endless driven outer belt which surrounds the inner belt with its inner strand in the region of a turning semicircle, the loaded trays being conveyed and turned between the inner and outer belts, a delivery and removal stage comprising a supply conveyor for feeding items to be washed into the unit interior and a tray receiving conveyor belt which is led with its one end substantially tangentially to the turning semicircle of the inner belt and carries out a substantially horizontal removal of the trays, and a washing stage comprising washing, rinsing and drying zones to which the items to be washed are led on transport conveyors, characterized in that the supply conveyor extends transverse to the tray receiving conveyor belt and includes a right-angle deflector (39) for deflecting trays transversely from the supply conveyor to the tray receiving conveyor belt, discharge belts (24, 25, 26) are present in the same number as items to be washed (20, 21, 22) of different outer transverse dimensions, and washing transport belts (44, 45, 46) are provided in the washing stage (III) in vertical superimposed parallel arrangement such that they respectively cooperate with one of the discharge belts (24, 25, 26) and further convey the flat lying items to be washed (20, 21, 22) through respective washing, rinsing and drying zones up to a separate items discharge in the discharge stage (IV).

2. Dish washing unit according to claim 1, characterized in that the inner conveyor belt (1) is a lattice belt which in the discharge direction has a substantially pear-shaped eccentric rotating path and is guided at its outer edge.

3. Dish washing unit according to claim 2, characterized in that radial nozzles (18) for prewashing of the items to be washed are provided which are effective along the turning semicircle through the inner lattice belt (1).

4. Dish washing unit according to claim 1, characterized in that the outer belt (2) is a double-chain conveyor belt, the inner and outer strands of which are substantially spaced and guided parallel with respect to one another and the turning semicircle.

5. Dish washing unit according to claim 4, characterized in that the outer belt (2) is provided with conveying rods (19) extending outwardly on the belt.

6. Dish washing unit according to claim 4, characterized in that an upper deflection roller (7) of the outer belt (2) is rearwardly displaced by approximately 30° with respect to the upper summit (23) of the turning semicircle on its periphery.

7. Dish washing unit according to claim 6, characterized in that the inclined discharge belt (25) has anti-slide formations such as transverse beads, burls (51) and the like on the belt outer side supporting the dishes.

8. Dish washing unit according to claim 7, characterized in that the arrangement of the anti-slide formations on the belt is such that a downward sliding in the transport direction as well as a sliding to the sides is prevented.

9. Dish washing unit according to claim 8, characterized in that the anti-slide formations have a V-arrangement.

10. Dish washing unit according to claim 1, characterized in that the supply conveyor is a transverse conveyor (37) with a driven roller belt (38) which supplies the trays (20) in the transverse direction to the unit, namely in the axial direction of the turning device and that a tray supply belt (41) effective between the last rollers of the supply belt and arranged in the same direction as the outer belt (2) is provided as the right-angle deflector (39).

11. Dish washing unit according to claim 10, characterized in that an end stop (40) is provided on the driven roller belt (38) for the trays (20) arriving in longitudinal alignment in the transverse direction of the unit, the arrangement of which stop is matched to that of the rearward lateral guide of the outer belt (2) for the trays (20).

12. Dish washing unit according to claim 10, characterized in that the transverse conveyor belt (37) of the supply conveyor is matched in terms of its conveyor speed at least with the tray supply belt (41) and the turning device (1, 2).

13. Dish washing unit according to claim 10, characterized in that at least one outwardly projecting pusher (42) is provided on the supply belt (41).

14. Dish washing unit according to claim 13, characterized in that two parallel supply belts are provided.

15. A dish washing unit for trays loaded with dishes, comprising:

a separating stage with a turning device consisting of an inner conveyor belt equipped at its outer side with substantially radially directed finger members/conveying rods and an endless driven outer belt which surrounds the inner belt with its inner strand in the region of turning semicircle, the loaded trays being conveyed and turned between the inner and outer belts, a delivery and removal stage comprising a supply conveyor for feeding items to be washed into the unit interior and a tray receiving conveyor belt which is led with its one end substantially tangentially to the turning semicircle of the inner belt and carries out a substantially horizontal removal of the trays, and a washing stage comprising washing, rinsing and drying zones to which the items to be washed are led on transport conveyors, characterized in that the supply conveyor is a transverse conveyor belt (37) with a right-angle deflector (39), discharge belts (24, 25, 26) are present in the same number as items to be washed (20, 21, 22) of different outer transverse dimensions, washing transport belts (44, 45, 46) are provided in the washing stage (III) in vertical superimposed parallel arrangement such that they respectively cooperate with one of the discharge belts (24, 25, 26) and further convey the flat lying items to be washed (20, 21, 22) through respective washing, rinsing and drying zones up to a separate items discharge in the discharge stage (IV), the first discharge belt (24) extends substantially tangentially to the upper summit (23) of the turning semicircle and supplies the larger part/trays (20) substantially horizontally to the upper washing belt (44), that a second discharge belt (25) leading away downwardly at an angle is provided and dimensioned such that it initially receives all further dishes (21, 22) of the items to be washed and cooperates with the lowest washing belt (46), and that in accordance with the further number of parts of items to be washed of various dimensions, a corresponding number of intermediate removing belts (26) are provided which are arranged to extend substantially horizontally and cooperate respectively with one of the parallel and vertically superimposed intermediate washing belts (45).

16. Dish washing unit according to claim 15, characterized in that the horizontal discharge belts (24, 26) are double-chain belts arranged in terms of their transverse dimensions and spacing such that a width reduction is present from top to bottom, wherein the removal ends for wide further items to be washed surround the narrowest inclined removing belt (25) leading to the lowest washing belt in the receiving zone.

17. Dish washing unit according to claim 15, characterized in that after receipt of the trays (20) by the first discharge belt (24) from the upper summit (23) of the turning semicircle, lead-in angles (36) leading to the second discharge belt (25) are provided on both sides which safely supply the dishes (21, 22) onto the downwardly leading second discharge belt (25).

18. Dish washing unit according to claim 17, characterized in that in the case of three discharge belts (24, 25, 26) being present, an upper horizontal tray belt (24), a middle horizontal belt (26) and an inclined belt (25) are provided, wherein the inclined belt consists of a removing slide (29) leading to the start of the middle belt (26) and a lower burled inclined belt (25).

19. Dishwashing unit according to claim 18, characterized in that the slide (20) has lateral guide walls which adjoin the side walls of the turning device in parallel and lead inwardly to a lower part as lead-in angles (36).

20. Dish washing unit according to claim 15, characterized in that the discharge belts (24, 25, 26) are driven by the same drive means (34) and the drive wheels or drive shafts (30, 35) are respectively arranged in superimposed vertical alignment.

* * * * *